United States Patent [19]

Weldle

[11] Patent Number: 4,635,530

[45] Date of Patent: Jan. 13, 1987

[54] AUTOMATIC HAND FIREARM WITH RIGIDLY LOCKED BREECH FOR AMMUNITION WITH EXTREMELY HIGH PROJECTILE MOMENTUM

[75] Inventor: Helmut Weldle, Oberndorf, Fed. Rep. of Germany

[73] Assignee: Heckler & Koch GmbH, Fed. Rep. of Germany

[21] Appl. No.: 805,401

[22] Filed: Dec. 4, 1985

Related U.S. Application Data

[63] Continuation of Ser. No. 552,676, Nov. 17, 1983, abandoned.

[30] Foreign Application Priority Data

Nov. 30, 1982 [DE] Fed. Rep. of Germany ..... 3244315

[51] Int. Cl.[4] ..... F41D 15/04; F41F 19/06

[52] U.S. Cl. ..... 89/159; 89/177; 89/193

[58] Field of Search ..... 89/159, 193, 177

[56] References Cited

U.S. PATENT DOCUMENTS

| | | | |
|---|---|---|---|
| 2,987,968 | 6/1961 | Jonson | 89/193 |
| 3,024,706 | 3/1962 | Wild | 89/193 |
| 3,036,501 | 5/1962 | Wild | 89/193 |
| 3,058,400 | 10/1962 | Hailston et al. | 89/193 |
| 3,110,222 | 11/1963 | Harvey | 89/159 |
| 3,171,326 | 3/1965 | Baker | 89/177 |
| 3,713,363 | 1/1973 | Hurlemann | 89/159 X |
| 3,805,668 | 4/1974 | Zellweger et al. | 89/177 |
| 3,890,881 | 6/1975 | Hurlemann et al. | 89/159 X |
| 3,985,062 | 10/1976 | Hupp et al. | 89/159 |
| 4,397,217 | 8/1983 | Hupp | 89/177 |

*Primary Examiner*—David H. Brown

*Attorney, Agent, or Firm*—McCormick, Paulding & Huber

[57] ABSTRACT

An automatic hand firearm for ammunition with extremely high projectile momentum is designed as a recoil loader which has a mounted barrel, supported by a spring and brake system (6, 7) on the weapon housing, a breech block (9, 10), which can be rigidly locked with the barrel and which encompasses a breech block carrier (9), movably led in the weapon housing (2) and supported on a breech-closing spring, and also encompasses a plug (10) which is longitudinally adjustable in relation to the breech block carrier, which carries locking parts (14) which can be engaged or disengaged with locking parts (15) on the barrel (1), and having devices comprising cams (18) and follow-up parts (17) for engaging-and-disengaging locking parts (14, 15) with the counterrecoil and recoil motion of the breech and with which the device for disengaging the locking parts (14, 15), arranged on the barrel (1) and on the plug (10), with the recoil motion of the breech block, is arranged between breech block carrier (9) and plug (10). If weaker ammunition is also to be fired with the same weapon, the loading process can be supported by an additional gas-operated-loading-device.

5 Claims, 5 Drawing Figures

Figure 1:
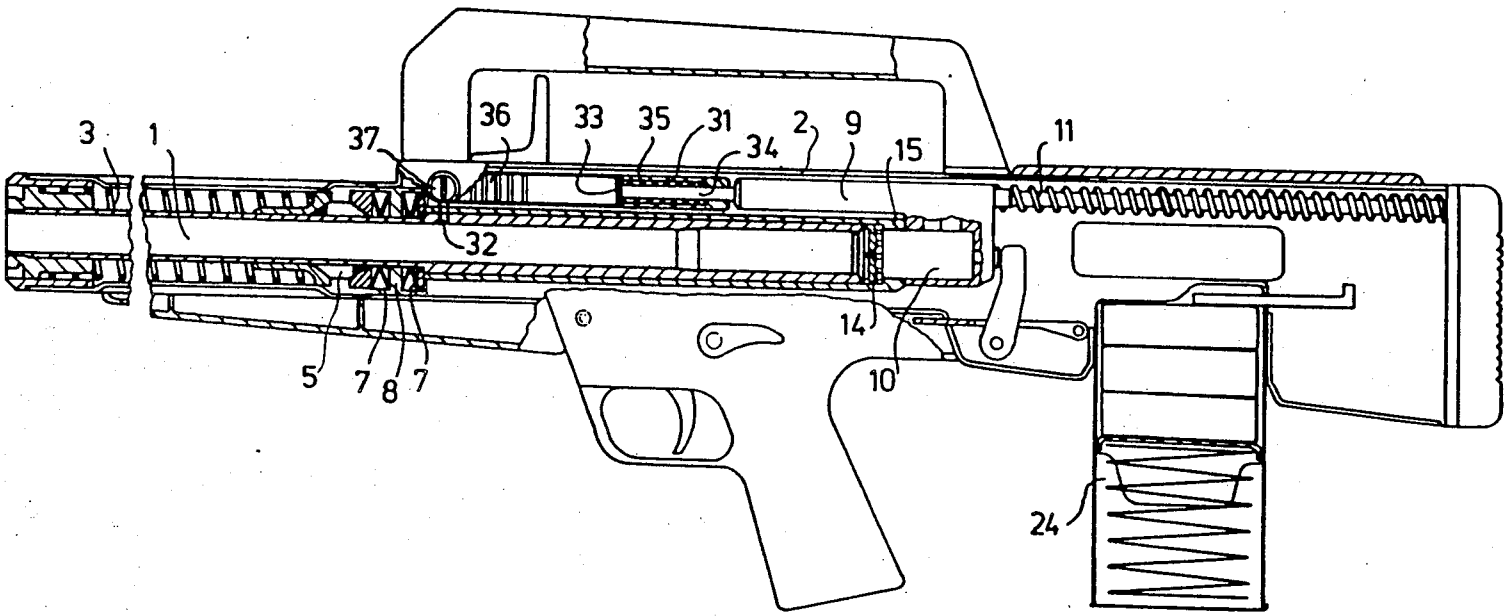

AUTOMATIC HAND FIREARM WITH RIGIDLY LOCKED BREECH FOR AMMUNITION WITH EXTREMELY HIGH PROJECTILE MOMENTUM

This is a continuation of co-pending application Ser. No. 552,676 filed on Nov. 17, 1983, now abandoned.

A need exists to fire ammunition with extremely high projectile momentum by means of hand firearms. An example of a weapon of this type is a combat shotgun, which makes it possible to bring a greater number of projectiles (large calibre shot) up to a distance of 100 to 150 m into the target. The firing of such ammunition with hand firearms is only possible if it succeeds in distributing, as evenly as possible, the projectile momentum over the time interval between two shots, so that the force to be absorbed by the rifleman always remains within limits which can be tolerated by the rifleman.

The firing of ammunition with extremely high projectile momentum is only possible when the weapon has a rigidly locked breech. Hand firearms with a rigidly locked breech are usually designed as gas-operated loaders. With gas-operated loaders, a connection to a gas cylinder, in which a movable piston is arranged which carries out, under the influence of the gas pressure acting on it, a movement causing the release of the breech, is established by a bore leading into the barrel of the weapon. Usually, a two-part breech block is used with gas-operated loaders, said breech block having a breech block carrier and a plug which is longitudinally movable in relation to the breech block carrier and which carries locking parts which can be engaged or disengaged with corresponding locking parts on the barrel of the weapon by the relative motion between breech block carrier and plug. The gas piston acts on the breech block carrier and gives the breech block carrier the relative motion, required for the release of the breech block to the plug. The release process usually only takes place after the projectile has left the barrel of the weapon, so that the rifleman must absorb the entire projectile momentum by way of the rigidly locked breech. Thus, with previously known hand firearms, firing of ammunition is possible only with relatively small projectile momentum.

Hand firearms with rigidly locked breeches, which are formed as recoil loaders, are, essentially, only known in form of pistols. Thereby, the barrel is, at first, taken along by the one-piece breech block until a lateral shifting by barrel or breech block takes place by way of cams attached in the housing, whereby locking pins attached to the breech disengage with the barrel, as, for example, with the Colt-Government pistol. The barrel is without springs thereby and is returned to the firing position by means of the striking breech when loading the weapon. With these types of weapons, the barrel strikes undamped on supports, which end its recoil motion and effects the release between barrel and breech block. The recoil impulse, transmitted onto the weapon, is so great that an arrangement of this type is completely unsuitable for ammunition with extremely high projectile momentum.

Of course, recoil loaders which have a two-piece breech block are also known from mounted machine weapons, however, the recoil forces, transmitted onto the weapon housing with such a breech system, are so strong that, until now, rigidly locked recoil loaders with a two-piece breech have not been used with hand firearms. In fact, with the known, stationary machine weapons, which are designed as recoil leaders with a two-piece breech block, the release of the breech block is effected in that the plug, returning with the barrel, has cam and follower elements, which, with the recoil of the barrel, run with the rigidly locked plug against cams in the barrel or breech housing and thus effect the release of the plug. At the moment of impact of the follow-up parts against the cams on the weapon housing, considerable kinetic energy is transmitted to the weapon housing. Thus, at this moment, very high force peaks result, which can, of course, with stationary machine weapons, be absorbed by the weapon housing and the mount carrying the weapon housing, but whose absorption by a rifleman is, in particular, no longer possible when the ammunition has a very high projectile momentum.

Accordingly, it is the object of the invention to design an automatic hand firearm in such a manner that the force, transmitted by the projectile momentum onto the weapon housing and to be absorbed by the rifleman, is almost uniform and, in any case, that strong force peaks are avoided.

This object is solved according to the invention by a weapon which is designed as a recoil loader, having a mounted barrel, supported by a spring and brake system on the weapon housing, a breech block, which can be rigidly locked with the barrel and which encompasses a breechblock carrier, movable in the weapon housing and supported on a breech-closing spring and also encompasses a plug which is longitudinally adjustable in relation to the breech block carrier, which carrier locking parts which can be engaged or disengaged with locking parts on the barrel, and having devices comprising cams and cam and follower elements for engaging-and-disengaging locking parts with the counterrecoil and recoil motion of the breech block and with which the device for disengaging the locking parts, arranged on the barrel and on the plug, with the recoil motion of the breech block, is arranged between breech block carrier and plug.

The invention, therefore, makes use of known principle of the recoil loader with rigidly locked, two-piece breech block, although this principle has previously only been used with stationary machine weapons, because the recoil impulse transmitted onto the weapon housing is so great that its absorption by a rifleman cannot be expected, so that the application of this principle with a hand firearm, intended for firing ammunition with extremely high projectile momentum, must appear as futile from the start. With the hand firearm according to the invention, however, unlike with the known recoil loaders, the relative motion between the breech block carrier and the plug is not effected by cams arranged in the weapon housing, but by devices which are attached between breech block carrier and plug. These devices come into effect in that, from the system comprising the recoiling barrel and the locked breech, the barrel is increasingly and to a much greater extent slowed down by the spring and brake system than the breech by the breech-closing spring, so that the breech block carrier endeavours to continue its movement with the initial speed imparted to it. As a result, the barrel with the locked plug remains increasingly behind the breech block carrier, whereby the release devices engage and effect the release of the plug, so that the breech block carrier with the plug can then completely separate itself from the barrel. Since the relative motion between breech block carrier and barrel is produced by braking the barrel, the relative motion increases slowly and steadily, so that the release of the plug is also started with the initial speed 0 and no jolts whatsoever appear thereby through which force peaks can be transmitted to the weapon housing. Even the sudden acceleration of the plug in the direction of motion the breech block carrier, which occurs after the release of the plug, does not lead to an increase but rather to a decrease of the force transmitted to the weapon housing because the breech block carrier, which exerts a certain force onto the weapon housing by way of the breech-closing spring, is slowed down. On the whole, this type of system can be adjusted in such a way that a projectile momentum can be ery evenly distributed over a greater time span, whereby it is possible for the rifleman to avoid unreasonable force peaks.

With a preferred embodiment of the invention, the plug is pivoted about its longitudinal axis with a cylindrical attachment in a bore of the breech block carrier and is held in the breech block carrier by a bolt which is inserted in a diagonal bore of the attachment and which engages in a slanting slot of the breech block carrier. and, as a result, also effects a rotation of the plug with a longitudinal movement of the plug in relation to the breech block carrier, which bolt, for its part, is secured in its position by the firing pin axially passing through the plug.

This type of embodiment is both especially simple and very stable, as is required for a hand firearm which is subjected to very high forces and which is intended for ammunition with extremely high projectile momentum.

In addition to those force peaks which arise due to the release processes, force peaks can also arise as a result of the barrel and/or the breech block still having a considerable speed at the end of their recoil motion and then strike quite hard on buffers which are attached to the weapon housing for this purpose. Since these force peaks are also disturbing, the previously described system must be planned in such a way that barrel and breech are almost completely stopped when they reach the intended end positions, so that the forces, which are required for the complete braking, which is necessary before the reversal of movement, do not appear as disturbing force peaks. As a result, the system according to the invention must be very accurately adjusted to the projectile momentum of the intended type of ammunition. If several types of ammunition with varying projectile momentum are to be fired with one weapon, the setting must be adjusted to the type of ammunition with the strongest projectile momentum, because the avoidance of excessive force peaks is absolutely necessary herefor, with the result that, with ammunition with lower projectle momentum, a trouble-free operation is no longer guaranteed because the projectile momentum is then possibly no longer adequate to effect the loading action. In order to remedy this and to enable use of the weapon according to the invention also for ammunition with varying projectile momentum, a further embodiment of the invention provides that the breech block carrier is, additionally, in operative connection with a gas-operated-loading-device, variable in its action, in particular, disconnectible. Such a gasoperated-loading-device can, in a known manner, have a cylinder, connected by a bore with the barrel, and a piston, movable attached in the cylinder acting on the breech block carrier; said positon then gives the breech block carrier an additional acceleration when firing ammunition with low projectile momentum, so that the loading action duly takes place. Thereby, the arrangement can be made, for example, in such a way that the gas-operated-loading-device, setting in a little delayed as a result of the gas flow processes, only has a negligible effect when ammunition with high projectile momentum is used with which a support by the gas-operated-loading-device is not required.

As especially simple way to influence the effect of the gas-operated-loading-device consists in the arrangement of a shut-off valve in the connection between barrel and cylinder. It is understood that "shuf-off valve" also refers to a value which not only either completely frees or completely blocks the connection between barrel and cylinder, but which can also be put into intermediate positions in which it more or less strongly throttles this connection. This type of valve can easily be designed in such a way that it can be adjusted to different types of ammunition. For example, the shut-off valve could be formed by a slide, which is arranged in the cylinder and which more or less closes or else frees the bore leading into the cylinder wall. Such a slide can be readily adjusted from the side turned away from the piston, without any sealing problems appearing thereby, because the slide, as well as the piston, can be tightly led along the side, turned away from the piston, of the bore in the cylinder.

With a preferred embodiment of the invention, care has been taken that a shut-off valve of this type does not have to be adjusted by hand to the various types of ammunition but is automatically brought into a position which is adapted to the projectile momentum of the respective ammunition. The use of the firearm according to the invention is not only simplified hereby, but it is above all guaranteed that, with a change of the type of ammunition, an adjustment of the shut-off valve is not necessary and hence not to be forgotten. As result of this kind of omission, prior art configurations are susceptible to encountering problems with too low a projectile momentum leading to jams or else, with too great a projectile momentum, leading to considerable target errors or even injuries as a result of too hard a recoil. This automatic adjustment of the shut-off valve is achieved with the preferred embodiment of the invention in that the position of the shut-off valve is controlled by an inert mass, movably mounted in relation to the barrel and loaded by a spring. As a result of selection of the proper size of the mass and the force of the spring on the recoil action of the barrel, the mass can only follow a slow recoil motion of the barrel, as occurs when firing ammunition with low projectile momentum, and thereby keep the valve open, whereas the mass remains behind in relation to the barrel and all the more effects a closing of the bore, the quicker the recoil motion of the barrel results with greater projectile momentum.

Even with such an embodiment of the invention, the shut-off valve can be formed by a slide arranged in the cylinder and this slide can directly form the inert mass effecting the vale position and be loaded by a spring, which is installed in the cylinder and which endeavours to hold the slide in an inoperable position, which is behind in relation to the firing direction and in which the slide frees the bore. It is particualrly useful if the slide is formed as a casing, which has, on its periphery, an annular tee-slot into which slot the bore leads when the slide assumes its in operable position and which is connected with the interior of the casing by way of radial bores. This construction of the slide guarantees that the forces exerted by the gas pressure on the casing equalize in axial direction and the position of the slide is independent of the gas pressure prevailing in the cylinder.

Figure 2:
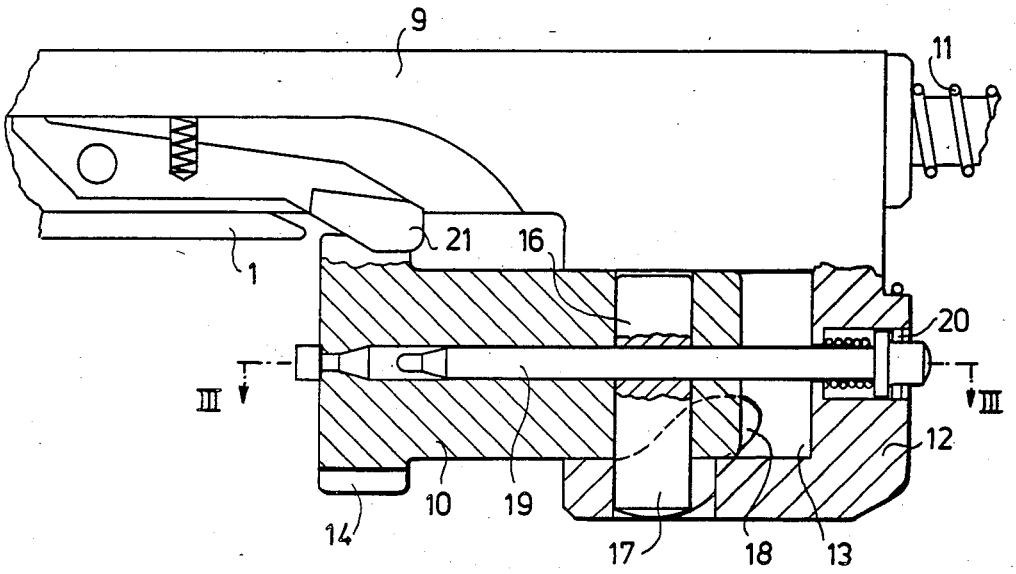
Figure 3:
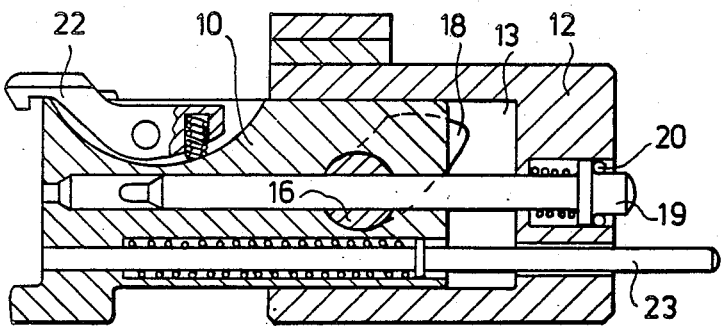
Figure 4:
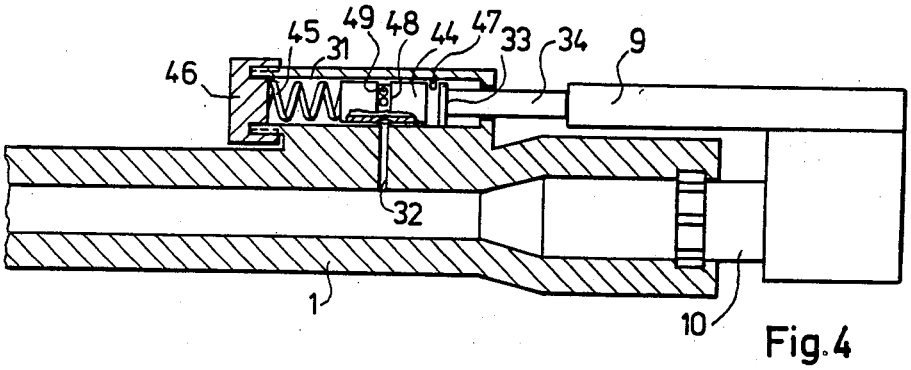
Figure 5:
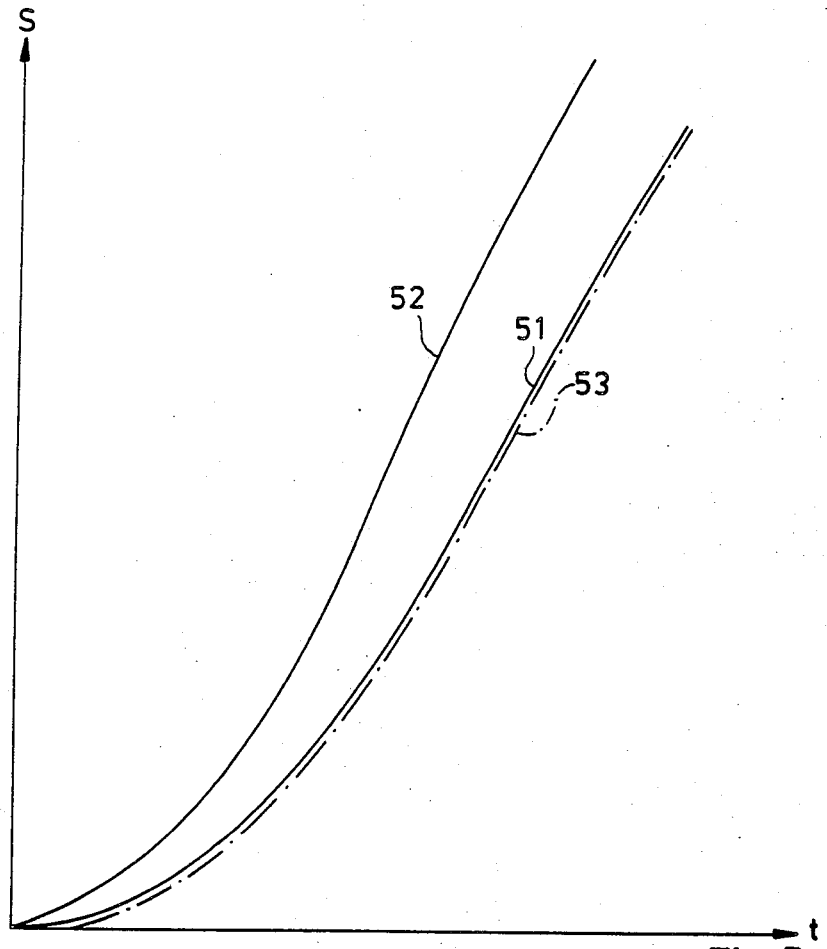

In the following, the invention is described and explained in greater detail with reference to the embodiments of the invention illustrated in the drawing. The features, which can be derived from the description and drawing, can be used individually or jointly in any combination with other embodiments. They show:

FIG. 1 a longitudinal section through a rifle constructed according to the invention, FIG. 2 a longitudinal section through the breech of the rifle according to FIG. 1, on a larger scale, FIG. 3 a cut along the line III—III through the arrangement according to FIG. 2, FIG. 4 a longitudinal section through a further embodiment of a gas-operated-loading-device for a rifle according to the invention and FIG. 5 a traverse/time diagram of the barrel and valve motion with the embodiment according to FIG. 4.

The barrel 1 of the rifle shown in FIG. 1 is movable mounted in its longitudinal direction in the weapon housing 2 and is propped by a recoil spring 3 and a system 6, containing a friction brake 5, on support 8 containing cup springs 7. A breech block, which consists of a breech block carrier 9, movable in its longitudinal direction in the weapon housing 2, and of a plug 10, which is rotatable about its longitudinal axis and can be rigidly locked with the back end of barrel 1, interacts with the back end of barrel 1. The breech block carrier 9 is loaded by a breech-closing spring 11 which abuts at the back end of the weapon housing 2. As can be seen in FIG. 2 and FIG. 3, the breech block carrier 9 has, on its bottom side, an attachment 12, in which a bore 13, concentric to the axis of barrel 1, is located and into which plug 10 engages. At the front end, plug 10 has radially projecting, axis parallel locking cams 14 which, with a locked breach blook, set behind corresponding locking cams 15 at the back end of the barrel 1. With a released breech, the cams 14 on the plug are opposite gaps between the locking cams 15 on barrel 1 and vice versa.

In the cylindric section of plug 10, there is a bolt 16, attached at right angles to the longitudinal axis, which extends with one end beyond the periphery of plug 10. This end forms a pin 17 which engages into a slot 18, which runs inclined to the surface line of plug 10 or bore 13 in the breech block carrier 9. By means of the engagement of pin 17 into the slanting slot 18, a form-locking connection, which allows a limited axial movement of plug 10 in relation to the breech block carrier 9 with simultaneous rotation, exists between the plug 10 and attachment 12 on the breech block carrier 10. Bolt 16 is held in plug 10 by the firing pin 19, which is inserted into corresponding bores, concentric to the axis of barrel 1, of breech block carrier 9 and plug 10 and held at its back end by an inserted clamp 20. FIG. 2 and FIG. 3 reveal additional details of the breech and component parts mounted in it, namely, a lever 21 for stopping plug 10 while released, an extractor hook 22 and a spring-suspended ejector bar 23. These details are, however, of a conventional type in their design and function and do not need to be explained in greater detail here since they do not belong to the invention.

The thusfar described component parts of the rifle form a fully operable recoil-operated loader. If a shot is fired with the position of the rifle shown in FIG. 1, with locked breech, then the recoil causes a return of barrel 1 together with the rigidly locked breech 9, 10. Thereby, the recoil of barrel 1 is more strongly braked by the recoil spring 3 and system 6 with the friction brake 5 than the breech block carrier 9 by the relatively weak breech-closing spring 11. Consequently, barrel 1 remains increasingly further behind the breech block carrier 9 while recoiling, so that a relative motion also takes place between breech block carrier 9 and plug 10, which results in a rotation of plug 10 controlled by slot 18 in conjunction with pin 17. In this way, the rigid locking between plug 10 and the back end of barrel 1 is released, so that later on the breech block carrier 9 also takes along plug 10 in axial direction and, thus, disconnects it from the back end of the barrel. When barrel 1 has reached the back end position, determined by the force of the recoil spring 3 and the characteristic property of system 6, it is again returned to its front position. In a similar manner, breech block carrier 9 is also returned to the front by the breech-closing spring 11 after reaching its back end position, whereby plug 10 takes along a cartridge from the magazine 24. A pushing in of plug 10 into bore 13 of breech block carrier 9 is prevented by the above-mentioned lever 21, which falls between the locking cams 14 on the plug as soon as the locking cams are separated from barrel 1. When plug 10 reaches the rear barrel end, lever 21 is deflected from the rear end of barrel 1 and attachment 12 of the breech block carrier 9 is pushed onto the cylindrical section of plug 10 and the plug is thereby rotated behind the locking cams 15 at the rear end of the barrel after the plug has attained its foremost position.

The special feature of the described recoil-operated loader is the separation of the breech block carrier 9 from barrel 1 with a differential speed beginning at 0, whereby the turning of the plug out of the locking mechanism is extended in time and, thus, a completely jolt-free release is guaranteed. Furthermore, the existing spring systems can be adjusted in such a way that, with ammunition with the greatest projectile momentum, that is, when there is no gas pressure support, the barrel reverses its direction of movement before it runs against a stop, mechanically limiting the recoil path, while the breach reaches its rear end position with a speed at which a trouble-free loading is still guaranteed, however, no force peaks worth mentioning appear anymore. Thus, the entire loading action can be controlled in such a way that the projectile momentum is very evenly distributed over an extended period and the rifleman is able to safely fire ammunition with extremely high projectile momentum.

Of course, such an adjustment makes it impossible to still also guarantee a trouble-free operation of the rifle when ammunition is to be fired which has a considerably lesser projectile momentum than the ammunition to which the recoil-operated-loading-system is adjusted. However, in order to be able to also use the rifle for those types of ammunition with lesser projectile momentum, the rifle has an additional gas-operated-loading-device. This gas-operated recoil-operated loading device comprises, in a conventional manner, a cylinder 31 which is fastened to the top of barrel 1 and is connected with the interior of the barrel by a radial bore 32. In the cylinder 31, a piston 33 is movably mounted which carriers, at its end in the rear in relation to the firing direction, a piston rod 34, which protrudes from the bottom of cylinder 31 and is opposite the front surface of the breech block carrier 9. The piston rod 34 is surrounded by a compression spring 35, which endeavours to hold piston 33 in the front position shown in FIG. 1. Between the radial bore 32, leading into barrel 1, and the interior 36 of the cylinder, which is adjacent to the front face of piston 33, there is a valve 37 which is formed with the illustrated embodiment, by a rotary slide, operable from outside, which either connects radial bore 32 with the interior 36 of cylinder 31 or else closes radial bore 32. This valve 37, therefore, enables one, when firing ammunition with extremely high projectile momentum, to deactivate the gas-operated-loading-device by blocking radial bore 32. On the other hand, when firing ammunition with lower projectile momentum, valve 37 can be opened, so that an additional acceleration is given to breech block carrier 9 by the gas pressure acting on piston 33; said acceleration guarantess that breech 9 is released and reaches its rear end position, as is required for a trouble-free loading action. Thus, even if the speed, given to barrel 1 and thus to breech 9, as a result of the recoil would not be sufficient to bring about a trouble-free separation between breech block and barrel that is, if such force were only to bring the breech block to its rear end position the action will be supplemented by gas pressure. The advantage of the embodiment of the rifle according to the invention is fully maintained, namely, that the release of the breech block is started completely jolt-free by the relative speed, slowing increasing as a result of braking barrel 1, of breech block carrier 9 in relation to barrel 1 and then merely accelerated by the gas pressure, becoming increasingly active, without resulting in any pressure peaks.

It is understood that value 37 does not have to have only two positions, with which the gas-operated-loading-system is either inoperative or operative, but that several positions are possible, with which bores of varying cross-sections are freed, in order to thereby more or less strongly throttle the gas flow entering into cylinder 31 and to thereby adapt the effect of the gas-operated-loading-device to several different types of ammunition. Irrespective of how many adjustment possibilities are provided, a valve of this type does however have the disadavantage that it must be adjusted manually to the respective type of ammunition, so that the possibility exits that the correct adjustment does not take place for a number of reasons. The embodiment shown in FIG. 4 automatically adjusts to the respective type of ammunition and, thus, guarantees that such errors cease when handling the rifle. In FIG. 4, barrel 1, breech block carrier 9 and plug 10, as well as cylinder 31 with the radial bores 32 leading into the barrel 1, piston 33 and piston rod 34 are only schematically indicated. Their design corresponds to the embodiment according to FIG. 1.

Unlike the embodiment of the invention according to FIG. 1, a slide 44, shaped as a casing, is movably mounted in its longitudinal direction in cylinder 31. this slide 44 is loaded, at its end in front in relation to the firing direction, by a compression spring 45, which is arranged in cylinder 31 and whose end, turned away from slide 44, abuts at a cover 46 screwed onto the front end of cylinder 31. The spring 45 endeavours to hold slide 44 in a rest position in which its rear end adjoins a stop 47, which is formed by a pin radially protruding into cylinder 31. Slide 44 has, on its periphery, an annular tee-slot 48, into whose area bore 32, connecting barrel 1 with cylinder 31, leads when slide 44 assumes its inoperable position, which is defined by its position at stop 47. The annular tee-slot 48 is connected by radial bores 49 with the interior of the casing-shaped slide 44, so that powder gases from the barrel 1 can enter into cylinder 31 by bore 32, annular tee-slot 48 and radial bores 49.

In FIG. 5, curves 51 and 52 illustrate the recoil motion of the barrel-breech-system with ammunition having weak or strong projectile momentum. The ordinates of the diagram according to FIG. 5 give path s and the abscissa time t during which the path s, marked by the ordinates, is covered. It can be readily seen that the motion of the barrel-breech-system, reproduced by curve 52, occurs a great deal more quickly with strong projectile momentum and, thus, also with greater acceleration that the recoil motion of the barrel-breech-system with weak projectile momentum, which is illustrated by curve 51. Curve 53, indicated by a dot-dash line, in FIG. 5 illustrates the motion of the system formed by slide 44 and compression spring 45. This system is adjusted in such a way that, with weak projectile momentum, the slide 44 follows the recoil motion of the barrel-breech-system, so that slide 44, therefore, retains its position in relation to this system and, during the entire recoil motion, bore 32 is in the area of slot 49 of slide 44 and propellent gases can enter into cylinder 31 without hindrance. The gas-operated-loading-device then becomes completely active in the above-described manner.

On the other hand, with strong projectile momentum, a relative motion occurs between the barrel-breech-system and slide 44, which is essentially given by the vertical distance between the curves 52 and 53 in FIG. 5. This means that slide 44 in cylinder 31 remains behind in relation to the quickly recoiling barrel 1, due to its mass moment of inertia against the force of the spring 45, so that it closes bore 32 between barrel 1 and cylinder 31 with its back section and, thus, prevents an overflow of gases into cylinder 31. Thus, the gas-operated-loading-device remains inactive, so that the entire loading action is effected exclusively by the recoil impulse.

It can be readily seen that the mass of slide 44 and the force of spring 45 can be chosen in such a way that, in connection with the designing of the control surfaces on slide 44, such an amount of gas is always admitted into cylinder 31 that, in a wide range of different types of ammunition, the impulse exerted by the recoil and the gas pressure on the barrel-breech-system or breech, is always sufficient to carry out the loading process in a trouble-free manner without, however, the impulse energy being substantially greater than the energy required for the loading process, so that no appreciable energy-surplus exists which would have to be destroyed and might lead to intolerable force peaks, It is understood that the invention is not restricted to the illustrated embodiments, but that variations thereof are possible within the scope of the invention. This is valid both for the special design of the spring and brake system for the mounted barrel, the design of the two-piece breech and, not least, for the design of the valves of the gas-operated-loading-device.

The reference designations in the patent claims do not represent any restrictions, they merely serve to provide a better understanding.

What is claimed:

1. In a firearm having a recoil operated shell loading mechanism and including a housing, a barrel slidably received in the housing for movement in a recoil and a counter-recoil direction, a recoil spring, a carrier also slidably received in the housing and cooperating with the breech end of the barrel to define a chamber for a loaded shell, a breech closing spring to urge the carrier in the counter-recoil direction, the improvement to said carrier characterized by a bolt mechanism comprising:

(a) firing pin means provided in said carrier, (b) a cylindrical breech block plug slidably received in a bore defined by said carrier and said plug defining an axially extending opening for receiving said firing pin means, said plug having a breech end and a recoil end, (c) locking means provided in part on the breech end of said plug and in part on the breech end of the barrel to normally lock said plug to said barrel, (d) coupling means between said barrel and carrier to selectively supplement said recoil operated loading mechanism by recoil gas pressure generated as a result of barrel recoil motion due to firing shells of low momentum, and means for disconnecting said coupling means in response to the recoil impulse encountered when shells of high momentum are fired, (e) camming means provided in part on said plug and in part on said carrier for rotating said plug in response to recoil and counter-recoil motion of the carrier, said plug rotation in the recoil direction causing disengagement of said locking means to release said plug from the barrel, and (f) said plug being movable axially relative to the carrier and barrel when so disengaged to provide a full recoil movement for said plug and assure proper loading of the a succeeding shell, and to provie for less than full recoil movement of the barrel when the barrel is so disengaged, (g) whereby positive shell loading and firing is accomplished with shells of both low and high momentum.

2. The firearm according to claim 1 wherein said coupling means more particularly comprises a cylinder defining a cylinder bore that communicates with a bore defined in the interior of the barrel, a piston movably mounted in the cylinder bore and acting on said carrier, and a shut-off valve arranged between the barrel and the cylinder bore.

3. The firearm according to claim 2 wherein said shut-off valve includes a valve element in the form of an inert slide element of predetermined mass, and a spring acting on said element mass in such a way that the mass of the valve element cooperates with the force of the spring during recoil action of the barrel such that said valve element follows a slow recoil motion of the barrel when firing ammunition of low projectile momentum, and operates to keep the shut-off valve open.

4. The firearm according to claim 3 wherein the said valve element is loosely received in the cylinder bore to provide substantial clearance between the valve slide and bore element.

5. The firearm according to claim 4 wherein said slide valve element defines a peripherially arranged tee-slot, said barrel defined bore communicating with said tee-slot when said slide valve element assumes a normal shut-off position for said shut-off valve.

* * * * *